US011114778B2

(12) United States Patent
Bingham

(10) Patent No.: US 11,114,778 B2
(45) Date of Patent: Sep. 7, 2021

(54) CABLE CONNECTOR TO PCB INTERCONNECT

(71) Applicant: Tektronix, Inc., Beaverton, OR (US)

(72) Inventor: Devin M. Bingham, Tigard, OR (US)

(73) Assignee: Tektronix, Inc., Beaverton, OR (US)

( * ) Notice: Subject to any disclaimer, the term of this patent is extended or adjusted under 35 U.S.C. 154(b) by 0 days.

(21) Appl. No.: 16/624,257

(22) PCT Filed: Apr. 17, 2018

(86) PCT No.: PCT/US2018/028037
§ 371 (c)(1),
(2) Date: Dec. 18, 2019

(87) PCT Pub. No.: WO2018/195125
PCT Pub. Date: Oct. 25, 2018

(65) Prior Publication Data

US 2020/0136282 A1 Apr. 30, 2020

Related U.S. Application Data

(60) Provisional application No. 62/486,362, filed on Apr. 17, 2017.

(51) Int. Cl.
*H01R 12/55* (2011.01)
*H01R 24/50* (2011.01)
(Continued)

(52) U.S. Cl.
CPC ..... *H01R 12/55* (2013.01); *H01R 24/50* (2013.01); *H01R 12/7047* (2013.01);
(Continued)

(58) Field of Classification Search
CPC .... H01R 12/55; H01R 24/50; H01R 13/6587; H01R 13/2414; H01R 12/712; H01R 12/7047
(Continued)

(56) References Cited

U.S. PATENT DOCUMENTS 8,672,688 B2 * 3/2014 Florence, Jr. ..... H01R 12/52 439/66
8,998,640 B1 * 4/2015 Mitchell, Jr. ..... H01R 13/6215 439/578
2010/0273350 A1 * 10/2010 Tutt ..... H01R 13/2414 439/578

OTHER PUBLICATIONS

International Bureau of WIPO, International Preliminary Report on Patentability for International Application No. PCT/US2018/028037, dated Oct. 31, 2019, Geneva, Switzerland.

* cited by examiner

*Primary Examiner* — Abdullah A Riyami
*Assistant Examiner* — Justin M Kratt
(74) *Attorney, Agent, or Firm* — Miller Nash Graham & Dunn; Andrew J. Harrington

(57) ABSTRACT

A device includes a coaxial connector that has a signal portion to electrically couple with a signal portion of a printed circuit board (PCB) to enable transmission of a signal therebetween, a ground portion to electrically couple with a ground portion of the PCB, and a mounting portion to interact with a mounting component to secure the coaxial connector to the PCB. The device also includes a compressible and conductive component to be positioned and deformed between the ground portion of the coaxial connector and the ground portion of the PCB, and a standoff positioned between the coaxial connector and the PCB and to accurately control deformation of the compressible and conductive component.

16 Claims, 6 Drawing Sheets

(51) Int. Cl.

| | |
|---|---|
| *H01R 13/6587* | (2011.01) |
| *H01R 13/24* | (2006.01) |
| *H01R 12/71* | (2011.01) |
| *H01R 12/70* | (2011.01) |

(52) U.S. Cl.
CPC ..... *H01R 12/712* (2013.01); *H01R 13/2414* (2013.01); *H01R 13/6587* (2013.01)

(58) Field of Classification Search
USPC ..... 439/63, 66, 581
See application file for complete search history.

CABLE CONNECTOR TO PCB INTERCONNECT

CROSS-REFERENCE TO RELATED APPLICATION

This application claims the benefit of U.S. Provisional Application Ser. No. 62/486,362, titled "BNC TO PCB INTERCONNECT" and filed on Apr. 17, 2017, the content of which is hereby fully incorporated by reference herein.

TECHNICAL FIELD

Embodiments of the disclosed technology generally relate to electrical components and devices and, in particular, to coaxial connectors.

BACKGROUND

Cable interconnections have limitations associated with the maximum frequency of a signal that may pass through an interconnect. Bayonet Neill-Concelman (BNC) connectors are a widely used physical connector for coupling a coaxial cable to a printed circuit board (PCB). However, the present maximum frequency of standard BNC to PCB connectors is less than what new standards propose. Difficulties in creating a new high-frequency BNC connector include making the physical connection rugged enough, achieving reliable solder connections, maintaining similar electrical properties across different connectors, and maintaining a smooth 50-ohm transition from the BNC body to the PCB and 50 ohm trace, as required by the standards.

Thus, there remains a need for an improved interconnect for coaxial cable to PCB connections.

DETAILED DESCRIPTION

Embodiments of the disclosed technology generally include a compressible and at least partially conductive component, such as a z-axis electrically conductive elastomer or similar compressible and conductive material, to provide an interface between a coaxial connector, such as a Bayonet Neill-Concelman (BNC) connector, and a printed circuit board (PCB). The addition of the elastomeric or other compressible material advantageously allows both a center pin and ground to be connected between a BNC connector and a PCB with a single, compliant interface. Whereas solder may cold flow under consistent pressure over time, elastomeric materials are naturally compressible, thus eliminating a potential for solder cold-flowing.

Certain embodiments may include coupling mechanisms other than soldering. For example, screws or other mechanical fasteners may be used to secure the BNC connector to the PCB. The addition of screws or other fastening mechanisms also make for a rugged BNC connector. In certain implementations, standoffs may be included between the BNC to the PCB surface to accurately control the compression of the elastomer material. Such a construction yields less variability between connectors and also removes a difficult and highly-variable solder process.

In certain embodiments, the elastomeric material may substantially, or completely, eliminate the traditional air gap between the center pin of a BNC connector and a corresponding signal via in a PCB. In prior systems, an air gap is created as the center pin leaves the BNC body and this gap creates an inductive region in the signal path. Adding a dielectric material between the center pin of the BNC connecter and the signal via of the PCB may reduce this inductance and create a more controlled impedance for lower voltage standing wave ratio (VSWR) in the signal path. Such an interface may be capable of maintaining a 50 ohm (or other) impedance to match the BNC for good signal fidelity.

Figure 1:
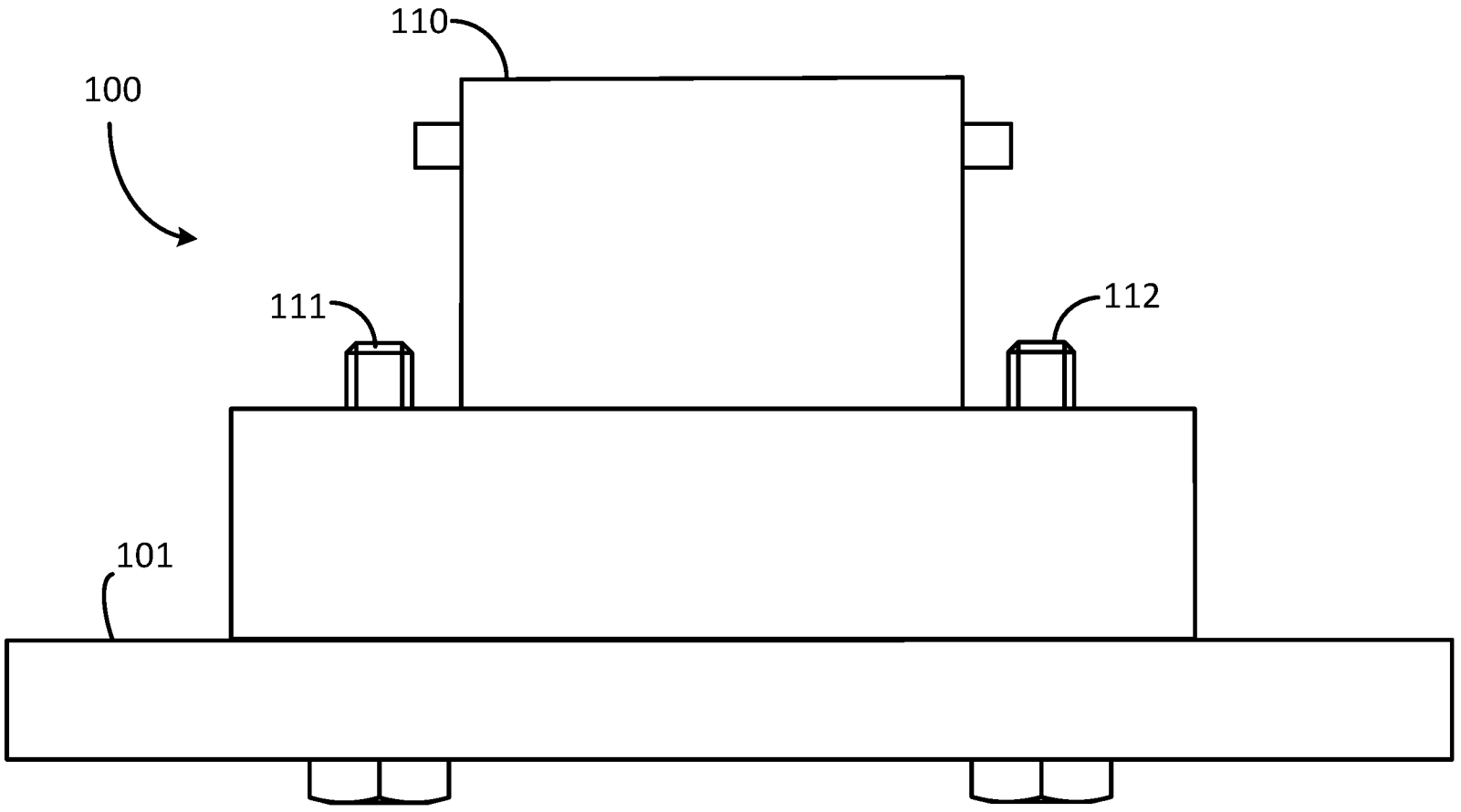
FIG. 1 illustrates a side view of an example system in accordance with certain implementations of the disclosed technology.

FIG. 1 illustrates a side view 100 of an example system in accordance with certain implementations of the disclosed technology. In the example 100, a coaxial connector 110, such as a BNC connector, is physically coupled with a PCB 101 by way of four mounting screws 111-114 (only 111 and 112 are visible in view 100). In alternative embodiments, the coaxial connector 110 may be secured to the PCB 101 by other suitable mechanisms such as clamps or mechanical fasteners, for example. The coaxial connector 110 may be used to establish and maintain an electrical connection between an attached coaxial cable and a signal path on the PCB, for example.

Figure 2:
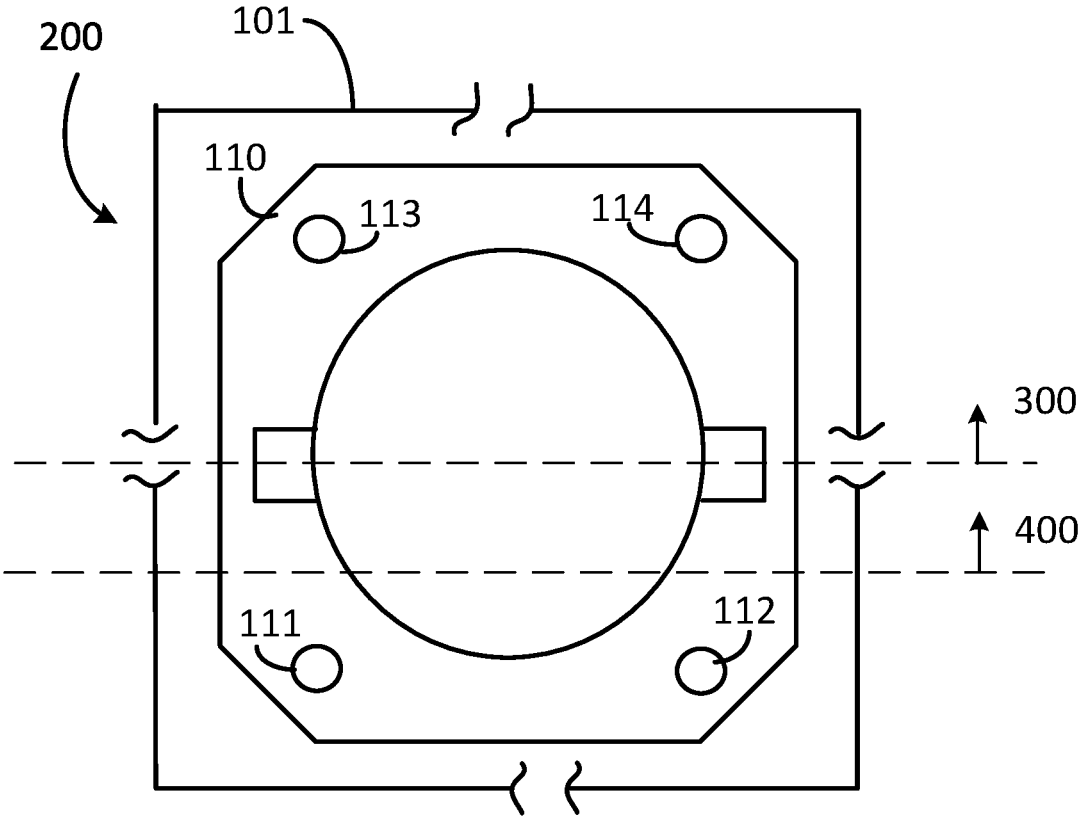
FIG. 2 illustrates a top view of the example system in accordance with certain implementations of the disclosed technology.

FIG. 2 illustrates a top view 200 of the example system in accordance with certain implementations of the disclosed technology. In this view 200, all four mounting screws 111-114 are visible. It will be appreciated that the PCB 101 may have any number or combination of signal paths, vias, and various components such as resistors and capacitors mounted thereon. Also, any suitable number of coaxial connectors may be mounted on or otherwise coupled with the PCB.

Figure 3:
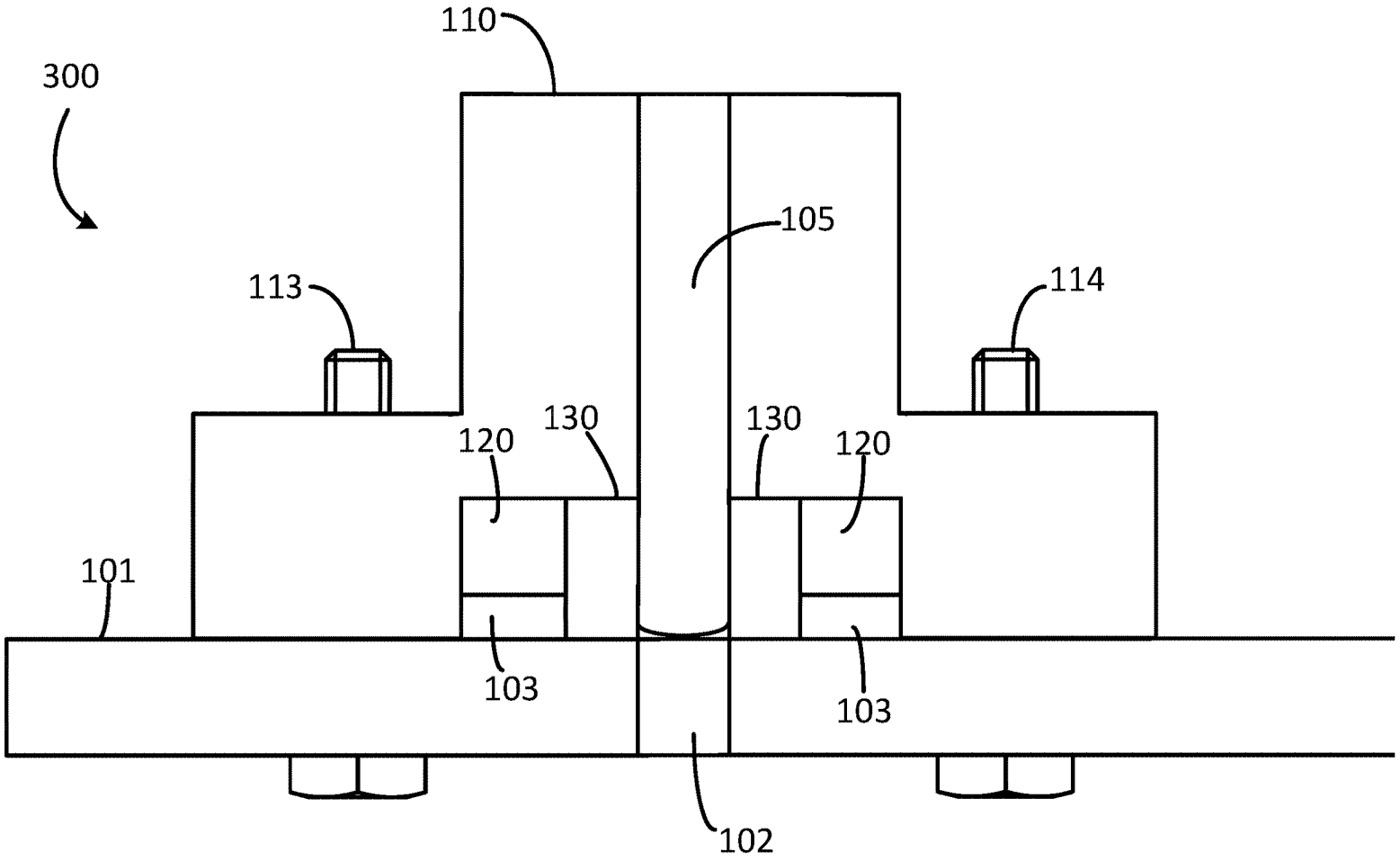
FIG. 3 illustrates a first cross-sectional view of the example system in accordance with certain implementations of the disclosed technology.

FIG. 3 illustrates a first cross-sectional view 300 of the example system in accordance with certain implementations of the disclosed technology. In this view 300, a center signal pin 105, such as a spring-loaded pogo pin, of the coaxial connector 110 is electrically coupled with a signal via 102 of the PCB 101. The signal pin 105 may be configured for effectively transmitting signals having a high frequency such as a frequency within a range of 4-10 GHz or greater, for example.

A compressible and at least partially conductive component 120, hereinafter compressible-conductive component 120, is electrically coupled with a ground portion 103 of the PCB 101. This compressible-conductive component 120 may also provide a mechanically rigid support for the physical coupling between the coaxial connector 110 and the PCB 101. The compressible-conductive component 120 may be at least partially compressed and/or deformed in association with the coaxial connector 110 being secured to the PCB 101. For example, such compressing and/or deforming may naturally result from the mounting screws 111-114 being tightened, e.g., by a torque wrench.

The compressible-conductive component 120 may include elastomeric material that may have, for example, silver and/or aluminum impregnated therein to provide for the conductivity. It will be appreciated that silver and aluminum are utilized purely for illustration and that other conductive materials could be utilized without departing from the scope of this disclosure. The compressible-conductive component 120 may be an elastomeric material that is z-axis electrically conductive and, thus, only electrically conductive in the z-axis. In certain embodiments, the compressible-conductive component 120 may be an elastomeric disc. In alternative embodiments, the compressible-conductive component 120 may include dielectric material such as silicon rubber, for example.

An insulated or otherwise non-conductive component 130 of the coaxial connector 110 may be configured to be positioned within the coaxial connector 110 between the conductive component 120 and the signal pin 105 to avoid a shorting of the signal pin 105, for example. In certain implementations, the non-conductive component 130 may be omitted and, in such embodiments, there will be an air gap between the signal pin 105 and the compressible-conductive component 120.

Figure 4:
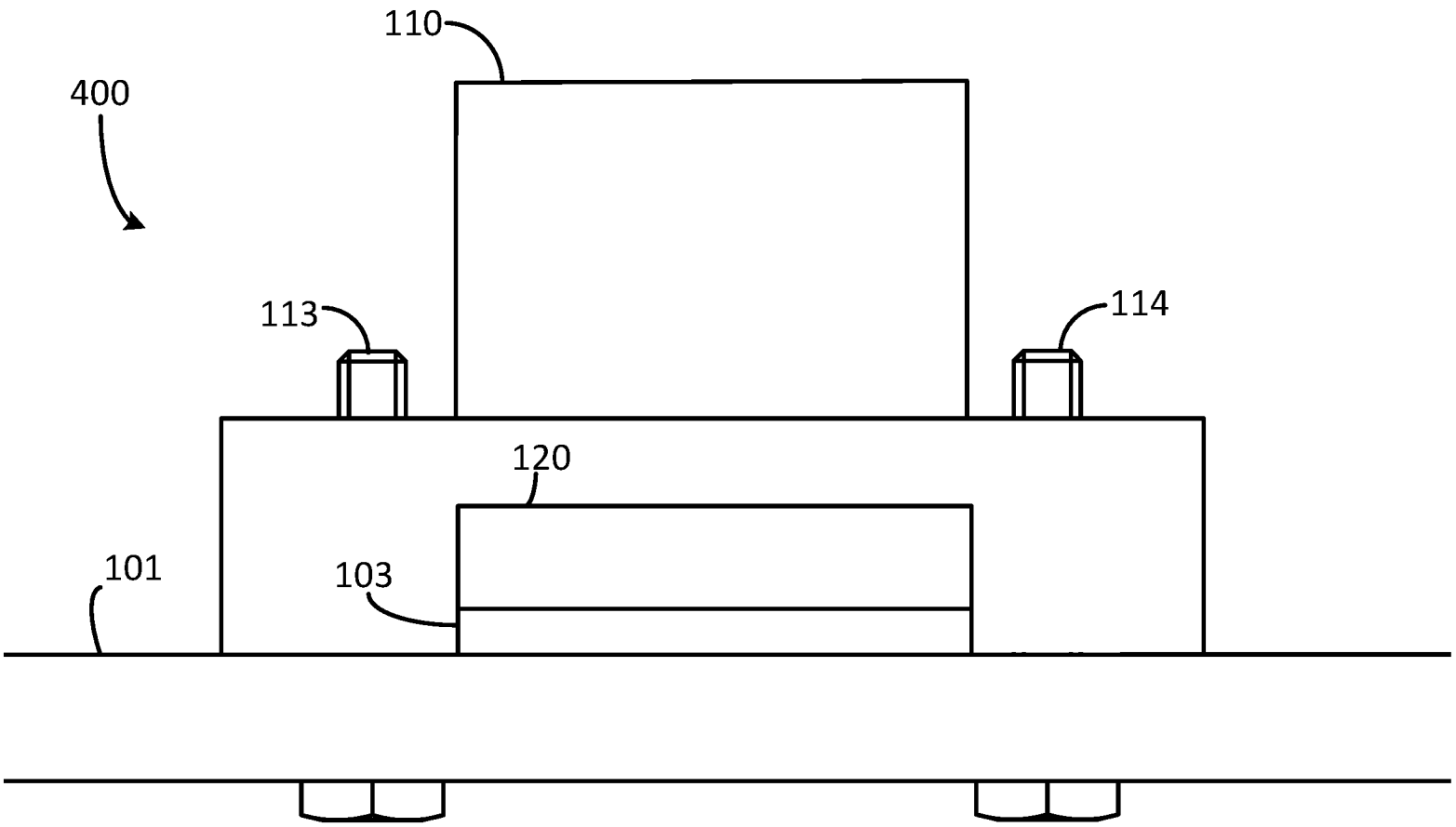
FIG. 4 illustrates a second cross-sectional view of the example system in accordance with certain implementations of the disclosed technology.

FIG. 4 illustrates a second cross-sectional view 400 of the example system in accordance with certain implementations of the disclosed technology. In this view 400, the compressible-conductive component 120, which is electrically coupled with the ground portion 103 of the PCB 101, can substantially, or completely, fill the air gap that would otherwise exist between the coaxial connector 110 and the PCB 101.

Figure 5:
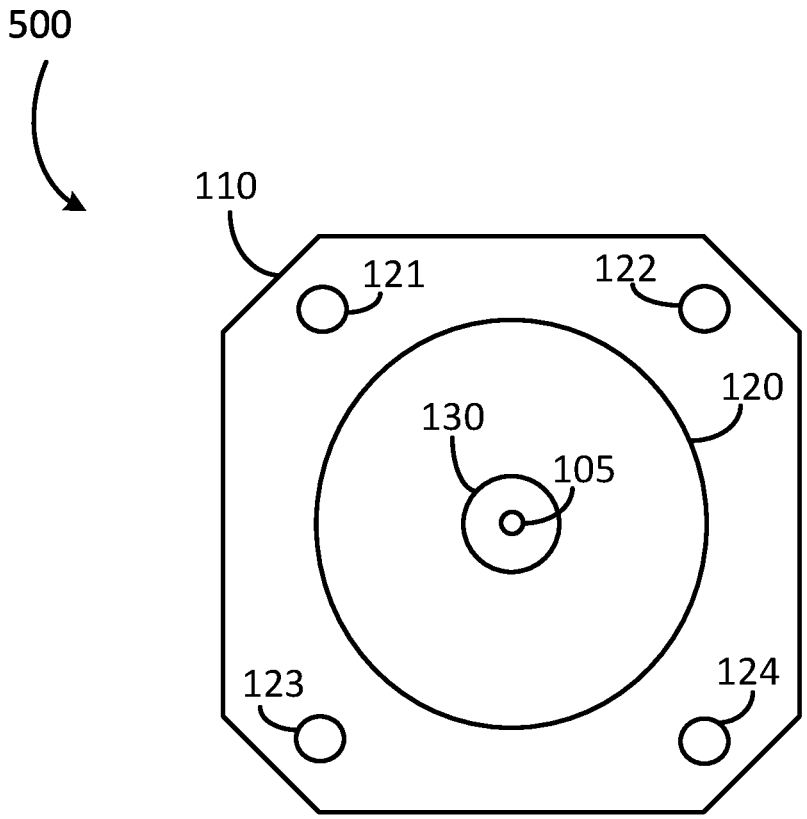
FIG. 5 illustrates a bottom view of the coaxial connector of the example system in accordance with certain implementations of the disclosed technology.

FIG. 5 illustrates a bottom view 500 of the coaxial connector 110 of the example system in accordance with certain implementations of the disclosed technology. In this view 500, the coaxial connector 110 includes four mounting holes 121-124 that may be configured to receive the mounting screws 111-114, respectively. In this view 500, the compressible-conductive component 120 is positioned within the coaxial connector. In alternative implementations, the coaxial connector 110 may not have any mounting holes and instead be configured to be secured to the PCB 101 by way of clamps or other suitable mechanical fasteners, for example.

Figure 6:
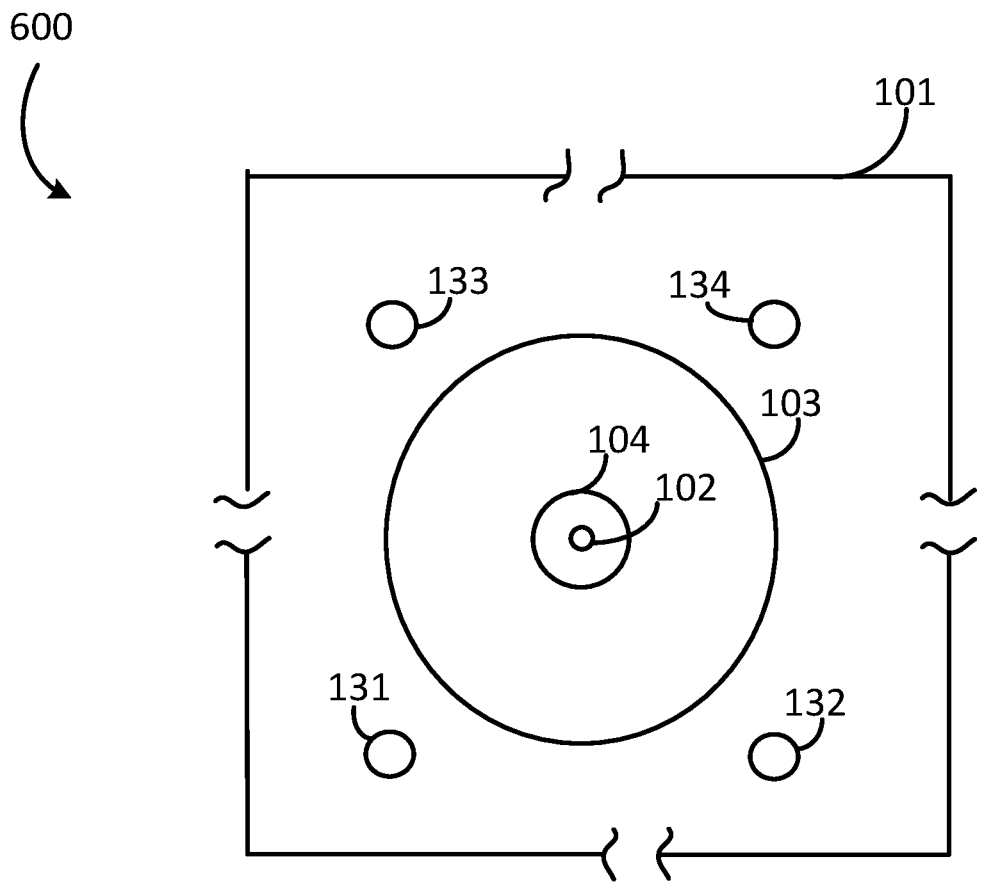
FIG. 6 illustrates a top view of the printed circuit board of the example system in accordance with certain implementations of the disclosed technology.

FIG. 6 illustrates a top view 600 of the printed circuit board 101 of the example system in accordance with certain implementations of the disclosed technology. In this view 600, the PCB 101 has a ground portion 103 and a signal via 102. The ground portion may be generated using immersion silver or immersion gold or other suitable material, for example. A non-ground portion 104 of the PCB 101 may naturally result from a masking process, photolithography process, or other process during the generating of the ground portion 103. Holes 131-134 may allow mounting screws 111-114 to pass through the PCB 101 to engage with the mounting holes 121-124 on the coaxial connector 110 shown in FIG. 5.

EXAMPLES

Illustrative examples of the technologies disclosed herein are provided below. An embodiment of the technologies may include any one or more, and any combination of, the examples described below.

Example 1 is directed to a device comprising a coaxial connector, the coaxial connector including: a signal portion configured to electrically couple with a signal portion of a printed circuit board (PCB) to enable transmission of a signal therebetween, a ground portion configured to electrically couple with a ground portion of the PCB to establish a common ground therebetween, and at least one mounting portion each of which is configured to interact with a mounting component to secure the coaxial connector to the PCB; and a compressible and at least partially conductive component configured to be positioned and at least partially deformed between the ground portion of the coaxial connector and the ground portion of the PCB.

Example 2 includes the subject matter of example 1, wherein the coaxial connector is a Bayonet Neill-Concelman (BNC) connector.

Example 3 includes the subject matter of any of examples 1-2, wherein the signal portion includes a pin.

Example 4 includes the subject matter of any of examples 1-3, further comprising a non-conductive portion configured to be positioned between the signal portion and the ground portion of the coaxial connector.

Example 5 includes the subject matter of any of examples 1-4, wherein the at least one mounting portion includes at least one mounting hole each of which is configured to receive the mounting component therethrough.

Example 6 includes the subject matter of example 5, wherein the mounting component is a screw.

Example 7 includes the subject matter of any of examples 1-4, wherein the mounting component includes a clamp.

Example 8 includes the subject matter of any of examples 1-7, wherein the compressible and at least partially conductive component includes an elastomeric disc.

Example 9 includes the subject matter of example 8, wherein the elastomeric disc contains one or both of silver and aluminum.

Example 10 includes the subject matter of any of examples 1-9, wherein the compressible and at least partially conductive component includes dielectric material.

Example 11 includes the subject matter of example 10, wherein the dielectric material includes silicon rubber.

Example 12 includes the subject matter of any of examples 1-11, wherein the compressible and at least partially conductive component is configured to provide rigidity to the signal portion of the coaxial connector.

Example 13 is directed to a system comprising a printed circuit board (PCB), the PCB including: a signal portion configured to carry a signal, and a ground portion; a coaxial connector, the coaxial connector including: a signal portion configured to electrically couple with the signal portion of the PCB to enable transmission of the signal therebetween, a ground portion configured to electrically couple with the ground portion of the PCB to establish a common ground therebetween; at least one mounting component to configured to secure the coaxial connector to the PCB; and a compressible and at least partially conductive component configured to be positioned and at least partially deformed between the ground portion of the coaxial connector and the ground portion of the PCB.

Example 14 includes the subject matter of example 13, wherein the coaxial connector is a Bayonet Neill-Concelman (BNC) connector.

Example 15 includes the subject matter of any of examples 13-14, wherein the signal portion includes a spring-loaded pin.

Example 16 includes the subject matter of any of examples 13-15, wherein the at least one mounting component includes one or both of a screw and a clamp.

Example 17 includes the subject matter of any of examples 13-16, wherein the compressible and at least partially conductive component includes an elastomeric disc.

Example 18 includes the subject matter of any of examples 13-17, wherein the compressible and at least partially conductive component is configured to provide rigidity to the signal portion of the coaxial connector.

Having described and illustrated the principles of the invention with reference to illustrated embodiments, it will be recognized that the illustrated embodiments may be modified in arrangement and detail without departing from such principles, and may be combined in any desired manner. And although the foregoing discussion has focused on particular embodiments, other configurations are contemplated.

In particular, even though expressions such as "according to an embodiment of the invention" or the like are used herein, these phrases are meant to generally reference embodiment possibilities, and are not intended to limit the invention to particular embodiment configurations. As used herein, these terms may reference the same or different embodiments that are combinable into other embodiments.

Consequently, in view of the wide variety of permutations to the embodiments described herein, this detailed description and accompanying material is intended to be illustrative only, and should not be taken as limiting the scope of the invention. What is claimed as the invention, therefore, is all such modifications as may come within the scope and spirit of the following claims and equivalents thereto.

The invention claimed is:

1. A device, comprising:

a coaxial connector, the coaxial connector including:

a signal portion configured to electrically couple with a signal portion of a printed circuit board (PCB) to enable transmission of a signal therebetween, a ground portion configured to electrically couple with a ground portion of the PCB to establish a common ground therebetween, and at least one mounting portion each of which is configured to interact with a mounting component to secure the coaxial connector to the PCB;

a compressible and conductive component configured to be positioned and deformed between the ground portion of the coaxial connector and the ground portion of the PCB; and a standoff positioned between the coaxial connector and the PCB and configured to accurately control deformation of the compressible and conductive component.

2. The device according to claim 1, wherein the coaxial connector is a Bayonet Neill-Concelman (BNC) connector.

3. The device according to claim 1, wherein the signal portion includes a pin.

4. The device according to claim 1, further comprising a non-conductive portion configured to be positioned between the signal portion and the ground portion of the coaxial connector.

5. The device according to claim 1, wherein the at least one mounting portion includes at least one mounting hole each of which is configured to receive the mounting component therethrough.

6. The device according to claim 5, wherein the mounting component is a screw.

7. The device according to claim 1, wherein the mounting component includes a clamp.

8. The device according to claim 1, wherein the compressible and conductive component includes an elastomeric disc.

9. The device according to claim 8, wherein the elastomeric disc contains one or both of silver and aluminum.

10. The device according to claim 1, wherein the compressible and conductive component includes dielectric material.

11. The device according to claim 10, wherein the dielectric material includes silicon rubber.

12. A system, comprising:

a printed circuit board (PCB), the PCB including:

a signal portion configured to carry a signal, and a ground portion;

a coaxial connector, the coaxial connector including:

a signal portion configured to electrically couple with the signal portion of the PCB to enable transmission of the signal therebetween, a ground portion configured to electrically couple with the ground portion of the PCB to establish a common ground therebetween;

at least one mounting component to configured to secure the coaxial connector to the PCB;

a compressible and conductive component configured to be positioned and deformed between the ground portion of the coaxial connector and the ground portion of the PCB; and a standoff positioned between the coaxial connector and the PCB and configured to accurately control deformation of the compressible and conductive component.

13. The system according to claim 12, wherein the coaxial connector is a Bayonet Neill-Concelman (BNC) connector.

14. The system according to claim 12, the coaxial connector further comprising a non-conductive portion configured to be positioned between the signal portion and the ground portion of the coaxial connector.

15. The system according to claim 12, wherein the at least one mounting component includes one or both of a screw and a clamp.

16. The system according to claim 12, wherein the compressible and conductive component includes an elastomeric disc.

* * * * *